US011682815B2

(12) United States Patent
Chen et al.

(10) Patent No.: US 11,682,815 B2
(45) Date of Patent: Jun. 20, 2023

(54) PHASE SHIFTER INCLUDING A PHASE SHIFTING MEMBER ROTATABLE OVER AN ARC CIRCUIT SECTION THAT IS CONNECTED TO CABLES SECURED TO THE PHASE SHIFTER

(71) Applicant: Kunshan Luxshare RF Technology Co., Ltd., Suzhou (CN)

(72) Inventors: Lu Chen, Suzhou (CN); ChengYu Xu, Suzhou (CN); ZhenHua Li, Suzhou (CN); WanQiang Zhang, Suzhou (CN); WenKai Xu, Suzhou (CN); MengYun Gu, Suzhou (CN); ZheXuan Xu, Suzhou (CN)

(73) Assignee: Kunshan Luxshare RF Technology Co., Ltd., Kunshan (CN)

( * ) Notice: Subject to any disclaimer, the term of this patent is extended or adjusted under 35 U.S.C. 154(b) by 0 days.

(21) Appl. No.: 17/376,383

(22) Filed: Jul. 15, 2021

(65) Prior Publication Data

US 2022/0029258 A1 Jan. 27, 2022

(30) Foreign Application Priority Data

Jul. 22, 2020 (CN) ..... 202021459219.5

(51) Int. Cl.
*H01P 1/18* (2006.01)

(52) U.S. Cl.
CPC ..... *H01P 1/18* (2013.01); *H01P 1/184* (2013.01)

(58) Field of Classification Search
CPC ..... H01P 1/184; H01P 1/18
USPC ..... 333/161
See application file for complete search history.

(56) References Cited

U.S. PATENT DOCUMENTS 7,463,190 B2 * 12/2008 Zimmerman ..... H01Q 3/32 333/156
2003/0076198 A1 * 4/2003 Phillips et al. ..... H01Q 3/26 333/161

FOREIGN PATENT DOCUMENTS

CN 209357881 U 9/2019
CN 108475834 B 1/2020

* cited by examiner

*Primary Examiner* — Benny T Lee
(74) *Attorney, Agent, or Firm* — Birch, Stewart, Kolasch & Birch, LLP

(57) ABSTRACT

A phase shifter, comprising a base, a circuit substrate, a phase-shifting member, and a plurality of first output cables. The circuit substrate is disposed on the base, and comprises a main feeder circuit and at least one sub-feeder circuit. The main feeder circuit comprises a main input circuit section. The at least one sub-feeder circuit is disposed on one side of the main feeder circuit, and comprises two output circuit sections and an arc circuit section. The arc circuit section is disposed between the two output circuit sections. The phase-shifting member is rotatably connected with the circuit substrate and comprises a coupling band. One end of the coupling band corresponds to and is coupled to the main input circuit section while the other end corresponds to and is coupled to the arc circuit section.

18 Claims, 9 Drawing Sheets

PHASE SHIFTER INCLUDING A PHASE SHIFTING MEMBER ROTATABLE OVER AN ARC CIRCUIT SECTION THAT IS CONNECTED TO CABLES SECURED TO THE PHASE SHIFTER

CROSS-REFERENCE TO RELATED APPLICATION

This application claims the priority benefit of Chinese Patent Application Serial Number 202021459219.5, filed on Jul. 22, 2020, the full disclosure of which is incorporated herein by reference.

BACKGROUND

Technical Field

The present disclosure relates to the technical field of wireless communication, particularly to a phase shifter.

Related Art

With the development of 5G communication technology and the increase of communication frequency bands, dual-polarized multi-band base station antennas have been taken a major share of the market. The key to realizing the intelligence of the antenna is the real-time adjustment of an electromagnetic beam pointing direction and coverage according to the changes in the distribution area of end users.

A phase shifter is the core assembly that changes the pointing direction of a wave speed of an antenna and can change the beam pointing direction by adjusting the phase difference assigned to each radiating unit. Theoretically, the phase difference can be changed in many ways. The most commonly used method is to directly change the length of the current path, such as a PCB board phase shifter. Alternatively, a dielectric sheet can be used to change the dielectric constant around the current path, such as a cavity dielectric phase shifter.

Changing the length of the current path to adjust the phase difference (using a PCB board phase shifter), in general, is to adjust the length of the coaxial cable connected to the phase shifter. In fact, at frequency band 698 to 960 MHz and frequency band 1710 to 2690 MHz, it is feasible to adjust the phase difference through coaxial lines in different lengths. However, a coaxial line having a length of only 1 mm would cause a phase change of 6.45 degrees, and the tangent tolerance can only be controlled within ±0.5 mm in mass production. That is, the maximum positive value and the maximum negative value of the tangent tolerance may cause a phase change of 6.45 degrees, leading to an error in the angle of downward inclination. Thus, it is an urgent issue to solve the problem of the phase change caused by the tangent tolerance.

SUMMARY OF THE INVENTION

As limited by the production tolerance of the coaxial lines, the embodiments of the present disclosure provide a phase shifter to solve the problem of resulted inaccurate phase angle when changing the phase angle with coaxial lines in the unequal length of conventional phase shifters.

The present disclosure provides a phase shifter, comprising a base, a circuit substrate, a phase-shifting member, and a plurality of first output cables. The circuit substrate is disposed on the base, and comprises a main feeder circuit and at least one sub-feeder circuit. The main feeder circuit comprises a main input circuit section. The at least one sub-feeder circuit is disposed on one side of the main feeder circuit and comprises two output circuit sections and an arc circuit section. The arc circuit section is disposed between the two output circuit sections. The phase-shifting member is rotatably connected with the circuit substrate and comprises a coupling band. One end of the coupling band corresponds to and is coupled to the main input circuit section while the other end corresponds to and is coupled to the arc circuit section. The plurality of first output cables are respectively connected to one end of the corresponding output circuit section away from the arc circuit section. Each of the phase values output by the plurality of first output cables is different from other phase values output by the plurality of first output cables. The plurality of first output cables are in the same length. The length of each of the output circuit sections is different from the length of other output circuit sections. The length of each of the output circuit sections is determined by the phase value output by the first output cable connected with the output circuit section.

In the embodiments of the present disclosure, since the phase shifter uses coaxial lines in equal length, the product yield in the case of mass production could be improved when the coaxial line products are manufactured for only one size, which could further avoid the lack of accuracy due to tangent tolerances.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

Figure 1:
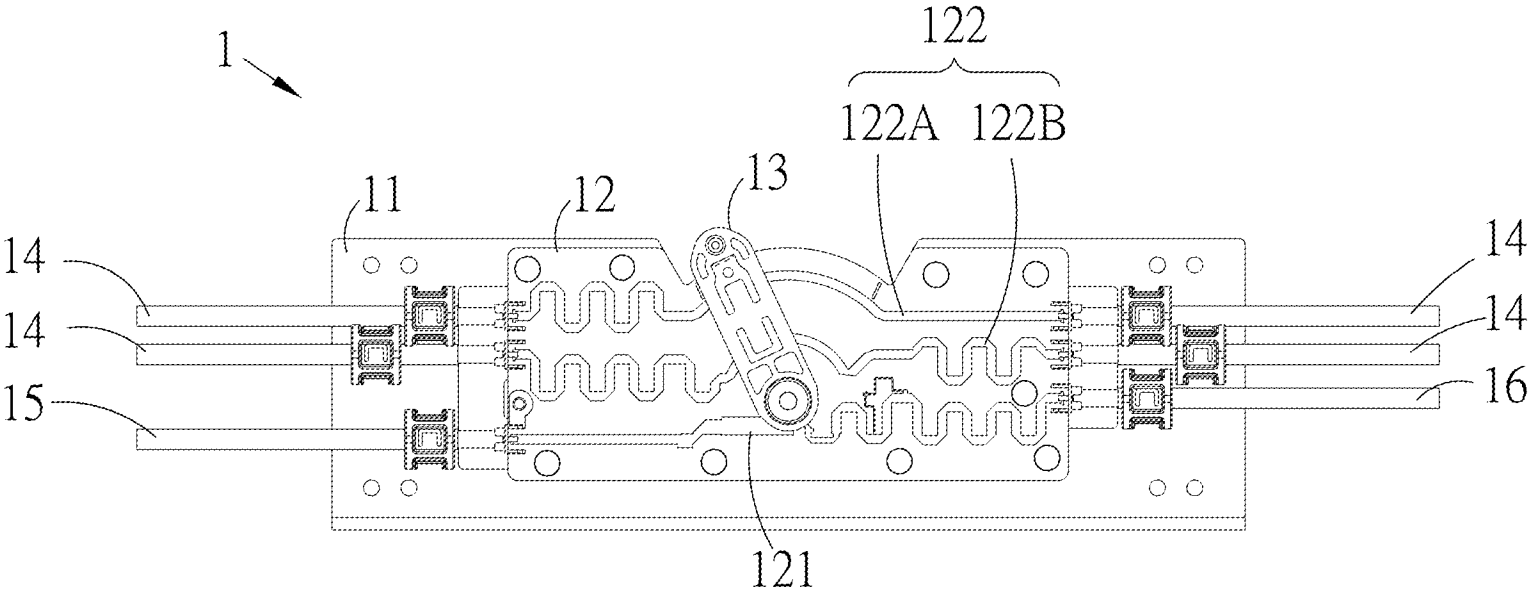
FIG. 1 is a front view of a phase shifter of an embodiment of the present disclosure.
Figure 2:
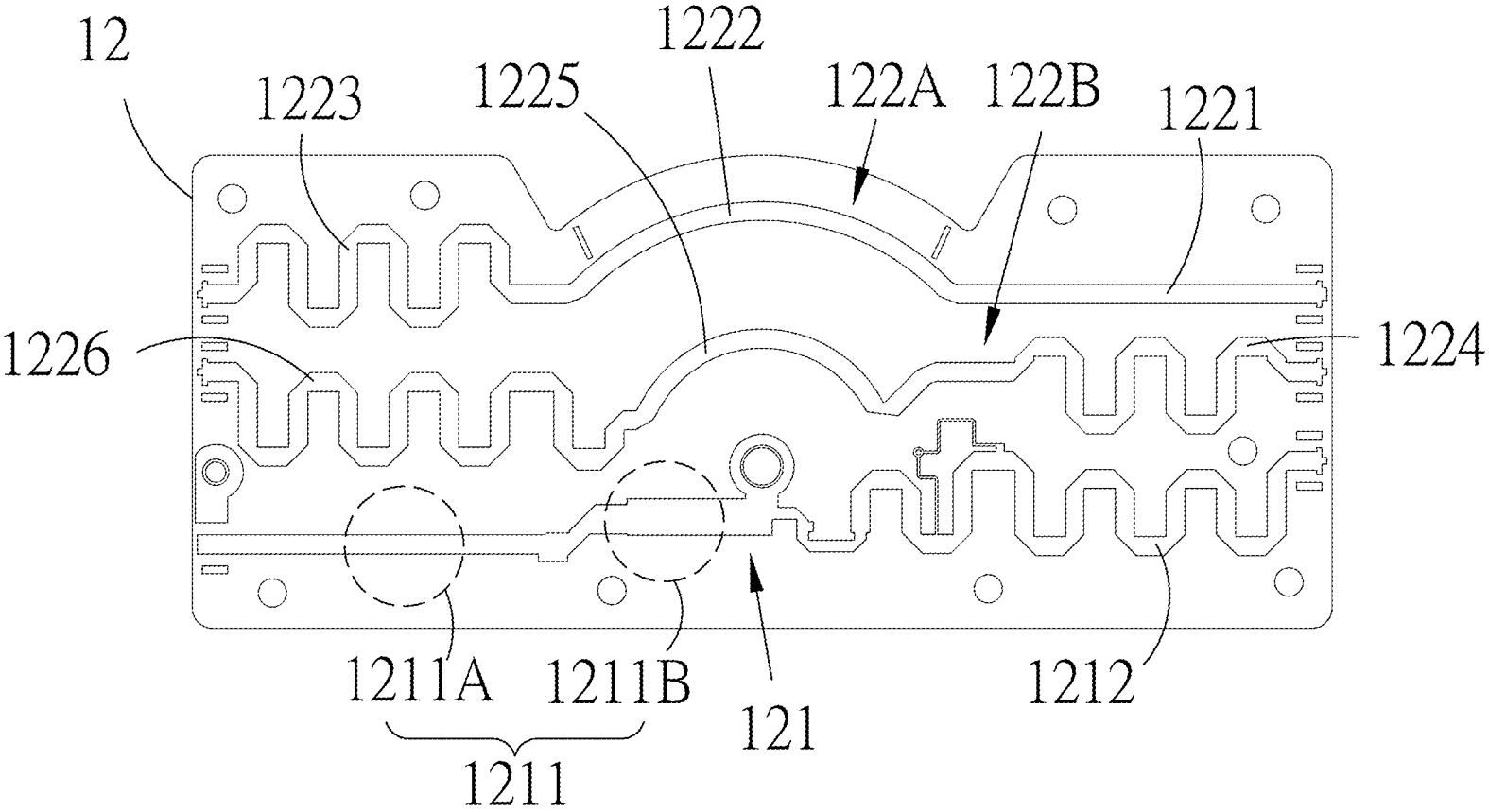
FIG. 2 is a schematic diagram of a circuit substrate of an embodiment of the present disclosure.
Figure 3:
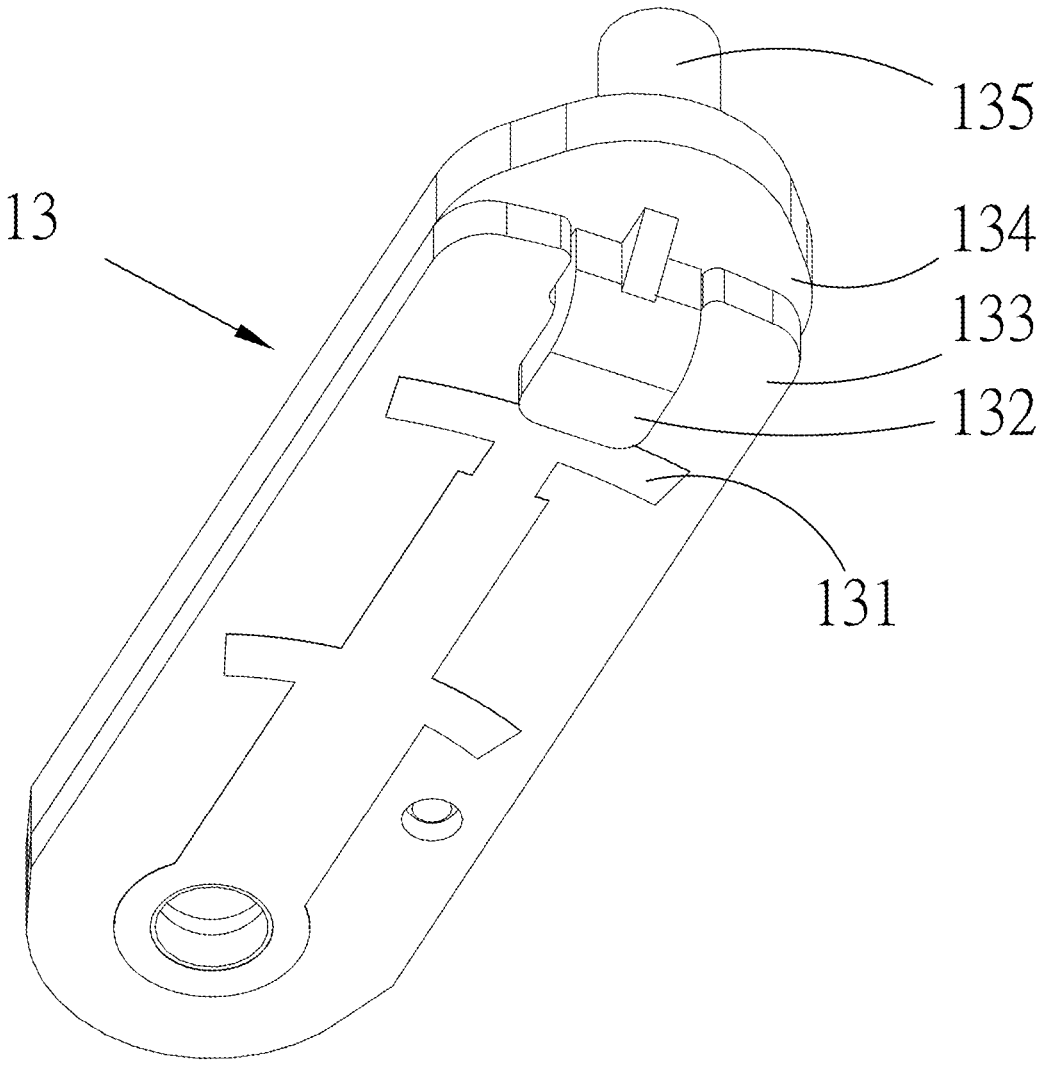
FIG. 3 is a bottom view of a phase shifter of an embodiment of the present disclosure.

FIG. 1 and FIG. 2 are front view and a schematic diagram of a phase shifter of an embodiment of the present disclosure. As shown in FIG. 1 and FIG. 2, the phase shifter 1 comprises a base 11, a circuit substrate 12, a phase-shifting member 13, and a plurality of first output cables 14 as shown in FIG. 1. The circuit substrate 12 disposed on the base 11 comprises a main feeder circuit 121 and at least one sub-feeder circuit 122. The main feeder circuit 121 comprises a main input circuit section 1211 as shown in FIG. 2. The at least one sub-feeder circuit 122 is disposed on one side of the main feeder circuit 121. Each of the sub-feeder circuits 122 comprises two output circuit sections and an arc circuit section. The arc circuit section is disposed between the two output circuit sections. FIG. 3 is a bottom view of a phase shifter of an embodiment of the present disclosure.

The phase-shifting member 13 is rotatably connected with the circuit substrate 12 and comprises a coupling band 131 as shown in FIG. 3. The coupling band 131 is disposed on a surface of the phase-shifting member 13 close to the circuit substrate 12. One end of the coupling band 131 corresponds to and is coupled to the main input circuit section 1211 while the other end corresponds to and is coupled to the arc circuit section of each of the sub-feeder circuits 122. The plurality of first output cables 14 are respectively connected to one end of the corresponding output circuit section away from the arc circuit section. Each of the phase values output by the plurality of first output cables 14 is different from other phase values output by the plurality of first output cables 14. The plurality of first output cables 14 are in the same length. The length of each of the output circuit sections of the at least one sub-feeder circuit 122 is different from the length of other output circuit sections of the at least one sub-feeder circuit 122. The length of each of the output circuit sections is determined by the phase value output by the first output cable 14 connected with the output circuit section.

In one embodiment, the number of sub-feeder circuits 122 can be 1. For example, the first sub-feeder circuit 122A shown in FIG. 1 and FIG. 2 comprises a first output circuit section 1221, a second output circuit section 1223, and a first arc circuit section 1222 as shown in FIG. 2. The first arc circuit section 1222 is disposed between the first output circuit section 1221 and the second output circuit section 1223. Each of the phase values output by the plurality of first output cables 14 is different from other phase values output by the plurality of first output cables 14. The plurality of first output cables 14 are of the same length. The length of the first output circuit section 1221 and the length of the second output circuit section 1223 of the first sub-feeder circuit 122A are different. The length of the first output circuit section 1221 and the length of the second output circuit section 1223 are determined by the phase value output by the first output cable 14 connected thereto.

In one embodiment, the number of the sub-feeder circuits 122 is two, the first sub-feeder circuit 122A and the second sub-feeder circuit 122B (see FIG. 1 and FIG. 2). The first sub-feeder circuit 122A and the second sub-feeder circuit 122B are disposed on the upper side of the main feeder circuit 121 at intervals. The first sub-feeder circuit 122A is farther than the second sub-feeder circuit 122B from the main feeder circuit 121. The first sub-feeder circuit 122A comprises a first output circuit section 1221, a second output circuit section 1223, and a first arc circuit section 1222. The first arc circuit section 1222 is disposed between the first output circuit section 1221 and the second output circuit section 1223. In this embodiment, the first output circuit section 1221 is disposed on the right side of the first arc circuit section 1222, and the second output circuit section 1223 is disposed on the left side of the first arc circuit section 1222. The second sub-feeder circuit 122B comprises a third output circuit section 1224, a fourth output circuit section 1226, and a second arc circuit section 1225 as shown in FIG. 2. The second arc circuit section 1225 is disposed between the third output circuit section 1224 and the fourth output circuit section 1226. In this embodiment, the third output circuit section 1224 is disposed on the right side of the second arc circuit section 1225, and the fourth output circuit section 1226 is disposed on the left side of the second arc circuit section 1225.

In this embodiment, a gap exists between the output circuit section of each of the sub-feeder circuits 122 and the output circuit section of the adjacent sub-feeder circuit 122. The gap is greater than or equal to 2.5 mm. For example, the gap between the first output circuit section 1221 of the first sub-feeder circuit 122A and the third output circuit section 1224 of the second sub-feeder circuit 122B is greater than or equal to 2.5 mm. Similarly, a gap exists between the output circuit section of the sub-feeder circuit and the main input circuit section of the adjacent main feeder circuit close to the sub-feeder circuit. The distance is greater than or equal to 2.5 mm. For example, the shortest distance between the fourth output circuit section 1226 and the main input circuit section 1211 is 2.5 mm. Thus, mutual interference of signals of the circuits can be avoided during transmission through a gap among the circuits configured to be greater than or equal to 2.5 mm.

In one embodiment, the other end of the coupling band 131 corresponds to and is coupled with the first arc circuit section 1222 of the first sub-feeder circuit 122A and the second arc circuit section 1225 of the second sub-feeder circuit 122B, respectively. The details of the phase-shifting member 13 would be described hereinafter.

In one embodiment, the first output circuit section 1221, the second output circuit section 1223, the third output circuit section 1224, and the fourth output circuit section 1226 of this embodiment are respectively connected with the first output cable 14, which indicates that the number of first output cables 14 is four. The phase shifter 1 of this embodiment further comprises an input cable 15 (FIG. 1), which is connected with one end of the main input circuit section 1211 away from the coupling band 131 as shown in FIG. 3. The length of the input cable 15 is identical to the length of the first output cable 14.

For the description below, the first output cable 14 connected with the first output circuit section 1221 is here defined as the first output terminal, the first output cable 14 connected with the second output circuit section 1223 is here defined as the second output terminal, the first output cable 14 connected with the third output circuit section 1224 is here defined as the third output terminal, and the first output cable 14 connected with the fourth output circuit section 1226 is here defined as the fourth output terminal. The phase values output by the first output terminal, the second output terminal, the third output terminal, and the fourth output terminal are different.

In this embodiment, when the phase shifter 1 is in use, the main input circuit section 1211 of the main feeder circuit 121 is coupled to the arc circuit section of the sub-feeder circuit 122 through the coupling band 131 of the phase-shifting member 13, and the first output cable 14 connected with the output circuit section outputs a phase value. For example, when the first output terminal is desired to output a specific phase value, the main input circuit section 1211 of the main feeder circuit 121 would be coupled to the first arc circuit section 1222 of the first sub-feeder circuit 122A through the coupling band 131 of the phase-shifting member 13, and the first output cable 14 connected with the first output circuit section 1221 would output the specific phase value. When the second output terminal is desired to output another specific phase value, the main input circuit section 1211 of the main feeder circuit 121 would be coupled to the first arc circuit section 1222 of the first sub-feeder circuit 122A through the coupling band 131 of the phase-shifting member 13, and the first output cable 14 connected with the second output circuit section 1223 would output the other specific phase value.

Taking the first sub-feeder circuit 122A for further description, the coupling band 131 divides the arc circuit section into a first circuit and a second circuit. The first circuit is connected to the first output circuit section 1221, and the second circuit is connected to the second output circuit section 1223. The sum of the length of the first circuit, the length of the first output circuit section 1221, and the length of the first output cable 14 connected with the first output circuit section 1221 corresponds to the phase value output by the first output terminal. The sum of the length of the second circuit, the length of the second output circuit section 1223, and the length of the first output cable 14 connected with the second output circuit section 1223 corresponds to the phase value output by the second output terminal. The length of the first output cable 14 connected with the first output circuit section 1221 is identical to the length of the first output cable 14 connected with the second output circuit section, and the length of the first arc circuit section 1222 is in a fixed value. Thus, to make the phase value output by the first output terminal and the phase value output by the second output terminal different, only the length of the first output circuit section 1221 and the length of the second output circuit section 1223 can be adjusted. The principle of the second sub-feeder circuit 122B is the same as the principle of the first sub-feeder circuit 122A, which would not be repeated herein.

In one embodiment, the length of the first output circuit section 1221, the length of the second output circuit section 1223, the length of the third output circuit section 1224, and the length of the fourth output circuit section 1226 are different. The length of the first output circuit section 1221 is determined by the phase value output by the first output cable 14 (first output terminal) connected with the first output circuit section 1221. The length of the second output circuit section 1223 is determined by the phase value output by the first output cable 14 (second output terminal) connected with the second output circuit section 1223. The length of the third output circuit section 1224 is determined by the phase value output by the first output cable 14 (third output terminal) connected with the third output circuit section 1224. The length of the fourth output circuit section 1226 is determined by the phase value output by the first output cable 14 (fourth output terminal) connected with the second output circuit section 1223.

Therefore, the phase shifter 1 of this embodiment could use a first output cable 14 in a fixed length, and to change the phase value output by the first output terminal, the phase value output by the second output terminal, the phase value output by the third output terminal, and the phase value output by the fourth output terminal through the first output circuit section 1221, the second output circuit section 1223, the third output circuit section 1224, and the fourth output circuit section 1226 which are different in length.

Furthermore, at least one of the two output circuit sections of each of the sub-feeder circuits 122 comprises a bent section. For example, in the first sub-feeder circuit 122A, the first output circuit section 1221 does not comprise a bent section, and the second output circuit section comprises a bent section. In the second sub-feeder circuit 122B, both the third output circuit section and the fourth output circuit section comprise bent sections. Each of the bent sections comprises at least one bent part. In one embodiment, the bent section of the second output circuit section 1223 comprises three bent parts, that is, the three bent parts are arranged in series. The bent section of the third output circuit section 1224 comprises two bent parts, that is, the two bent parts are arranged in series. The bent section of the fourth output circuit section 1226 comprises 3.5 bent parts, that is, the 3.5 bent parts are arranged in series. In this embodiment, each of the bent parts is a U-shaped component, that is, each of the output circuit sections is a series of multiple U-shaped components. When the two output circuit sections of one sub-feeder circuit 122 comprise bent sections, the number of bent parts of the bent section of one output circuit section would be greater than the number of bent parts of the bent section of the other output circuit section. For example: in the second sub-feeder circuit 122B, the number of bent parts of the fourth output circuit section 1226 is greater than the number of bent parts of the third output circuit section 1224. The bent section of each of the output circuits is used to shorten the length of the sub-feeder circuit, so that the size of the circuit substrate 12 can be reduced, and thereby the size of the phase shifter 1 can be reduced. The number of bent parts of the bent section of each of the output circuit sections is also determined by the phase value output by the corresponding output terminal because the length of each of the output circuit sections is different from others. In addition, in order to be installed on the circuit substrate 12 having the same length at the same time, the number of bent parts of each of the output circuit sections is determined by the length of the output circuit section. In other words, the longer the length of the output circuit section, the greater the number of bent parts; the shorter the length of the output circuit section, the less the number of bent parts, even no bent section is required.

In addition, the phase shifter 1 further comprises a second output cable 16. The main feeder circuit 121 further comprises a main output circuit section 1212 as shown in FIG. 2. One end of the main output circuit section 1212 is connected with the main input circuit section 1211 while the other end is connected with the second output cable 16. The phase value output by the second output cable 16 is different from the phase value output by the plurality of first output cables 14. The length of the second output cable 16 is identical to the length of the first output cable 14. The length of the main output circuit section 1212 is determined by the phase value output by the second output cable 16. The second output cable 16 connected with the main output circuit section 1212 is referred as the fifth output terminal.

The configuration of the main output circuit section 1212 is identical to the configuration of the output circuit section of each of the sub-feeder circuits 122. In this embodiment, the main output circuit section 1212 comprises a bent section, and the bent section of the main output circuit section 1212 comprises a plurality of bent parts. The number of bent parts of the main output circuit section 1212 is greater than the number of bent parts of the second output circuit section 1223, the number of bent parts of the third output circuit section 1224, and the number of bent parts of the fourth output circuit section 1226. In one embodiment, the number of bent parts of the main output circuit section 1212 of this embodiment is 4.5, and the bent section of the main output circuit section 1212 is a series arrangement of 4.5 bent parts. Each of the bent parts is a U-shaped component. In other embodiments, the shape of the bent part of the bent section of the output circuit section may not be limited to be U-shaped. The shape of the bent part can also be any one of C type, S2 type, M type, and W type. It should be noted that the first arc circuit section 1222 and the second arc circuit section 1225 of this embodiment are arc-shaped without any obvious bent. That is, no bent section is provided on the first arc circuit section 1222 and the second arc circuit section 1225, which indicates that no bent part is provided or exists.

Figure 4:
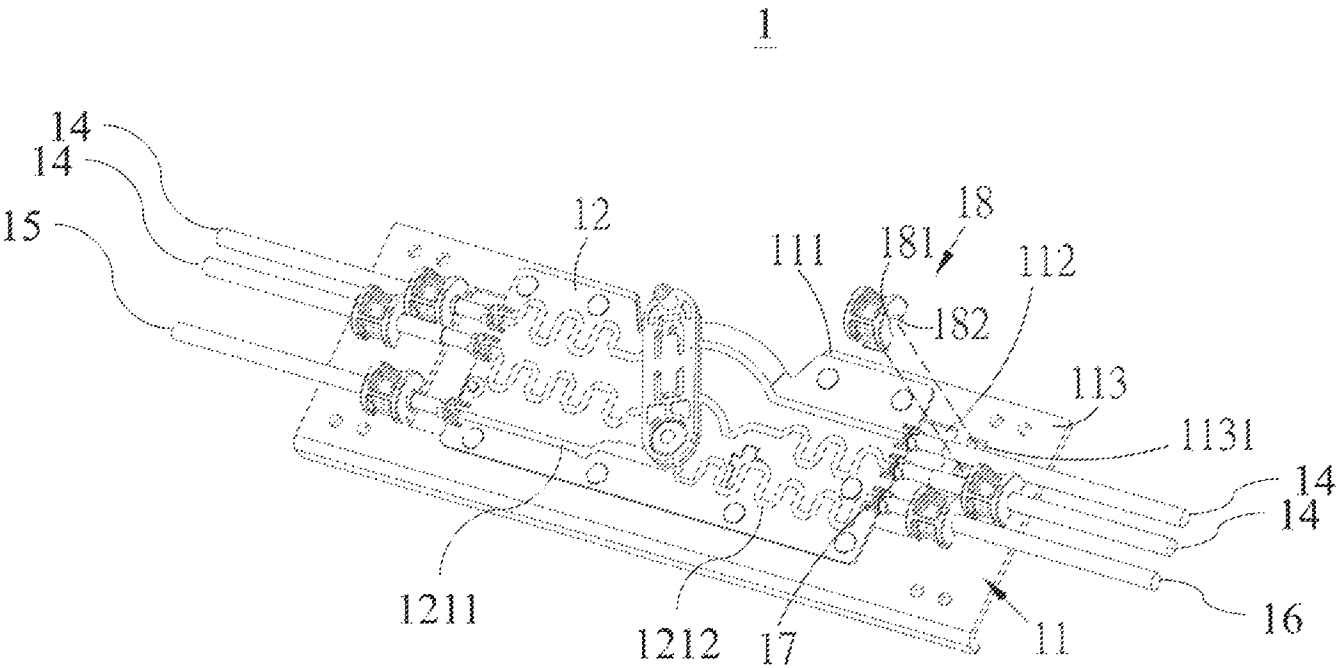
FIG. 4 is an oblique view of a phase shifter of an embodiment of the present disclosure.

FIG. 4 is an oblique view of a phase shifter of an embodiment of the present disclosure. As shown in the figure, the phase shifter 1 further comprises a plurality of cable connectors 17 and a plurality of cable securing members 18. The plurality of first output cables 14, the second output cable 16, and the input cable 15 are respectively secured on the circuit substrate 12 through the corresponding cable connectors 17. In other words, each of the first output cables 14 is secured on the circuit substrate 12 through the corresponding cable connector 17 to be connected with the corresponding output circuit section, the second output cable 16 is secured on the circuit substrate 12 through the corresponding cable connector 17 to be connected with the main output circuit section 1212, and the input cable 15 is secured on the circuit substrate 12 through the corresponding cable connector 17 to be connected with the main input circuit section 1211.

The plurality of the first output cables 14, the second output cable 16, and the input cable 15 are respectively secured on the base 11 through the corresponding cable securing members 18 to keep the plurality of first output cables 14, the second output cable 16, and the input cable 15 from interlacing and knotting during use, and to keep the plurality of first output cables 14, the second output cable 16, and the input cable 15 from being detached from the circuit substrate 12 due to external forces.

In one embodiment, the base 11 comprises a substrate securing part 111, an opening 112 and a cable securing part 113. The opening 112 penetrates the base 11 and is disposed between the substrate securing part 111 and the cable securing part 113. The circuit substrate 12 is secured on the substrate securing part 111. For example, the circuit substrate 12 can be securely connected to the substrate securing part 111 through rivets or glue. An edge of the circuit substrate 12 is overlapping with an edge of the opening 112 close to the substrate securing part 111. The cable connector 17 is disposed in the opening 112 and is clamped on the edge of the circuit substrate 12. The cable securing member 18 comprises a wire accommodating groove 181 and an engaging member 182. The engaging member 182 is engaged with the cable securing part 113. Specifically, a plurality of engaging holes 1131 could be provided on the cable securing part 113 in advance. In this way, when the first output cable 14, the second output cable 16, or the input cable 15 is disposed on the cable securing part 113, two sides of the first output cable 14, the second output cable 16 or the input cable 15 would be respectively provided with engaging holes 1131. When the cable securing member 18 is disposed on the first output cable 14, the second output cable, or the input cable 15, the first output cable 14, the second output cable, or the input cable 15 would be disposed in the wire accommodating groove 181 of the cable securing member 18. The engaging member 182 is disposed in the two engaging holes 1131 to secure the first output cable 14, the second output cable, or the input cable 15 onto the cable securing part 113.

Referring back to FIG. 2, the main input circuit section 1211 comprises an input end part 1211A and a coupling end part 1211B. The coupling end part 1211B is coupled to the coupling band 131 correspondingly as shown in FIG. 3. The width of the input end part 1211A is consistent. Furthermore, the input end part 1211A can also be configured to have a variety of different widths according to actual requirements. Since the resistance of a wire is inversely proportional to the volume of a conductor, when the thickness of the wire is consistent, the larger the width of the input end part 1211A, the smaller the resistance during signal transmission.

Figure 5:
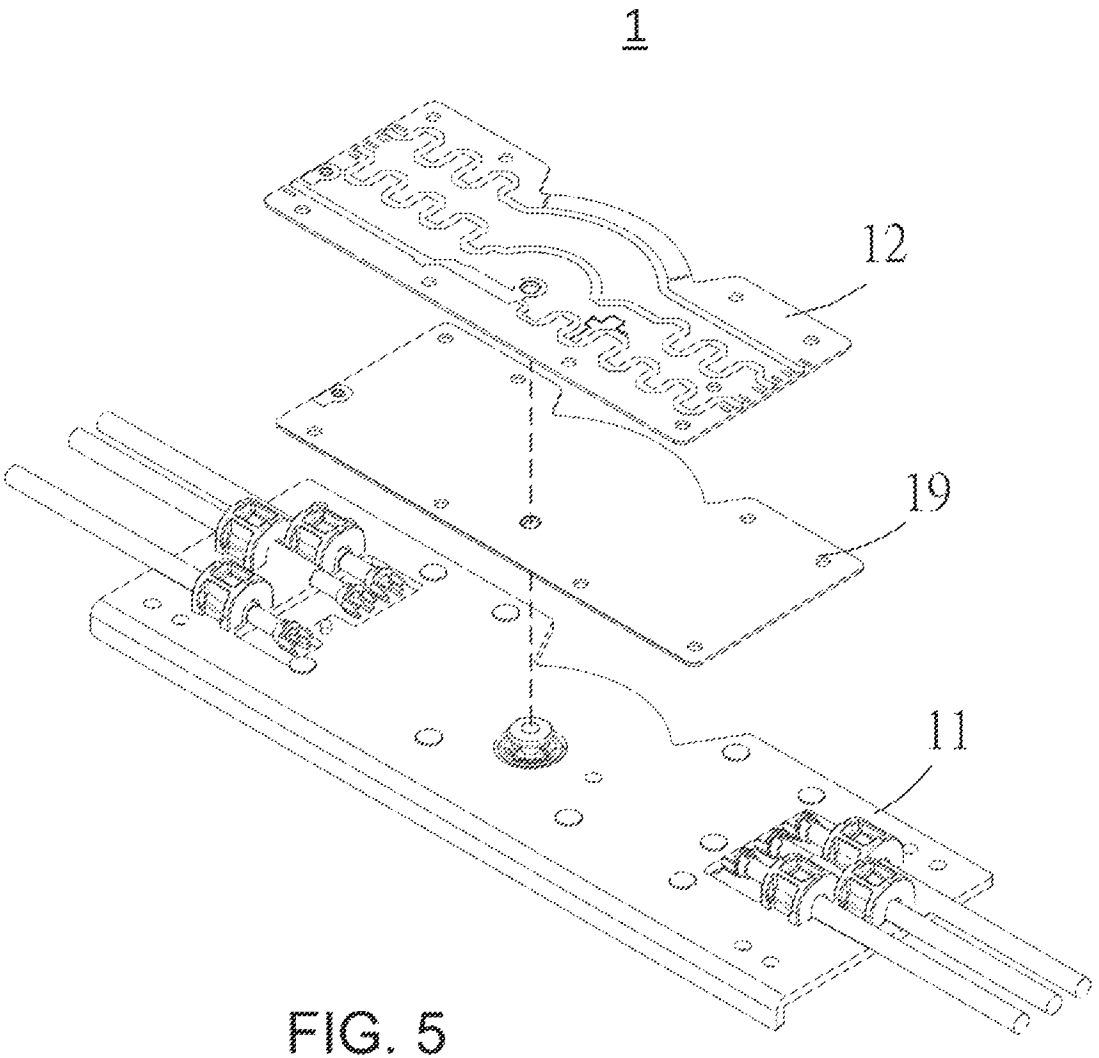
FIG. 5 is an exploded view of a phase shifter of an embodiment of the present disclosure.
Figure 6:
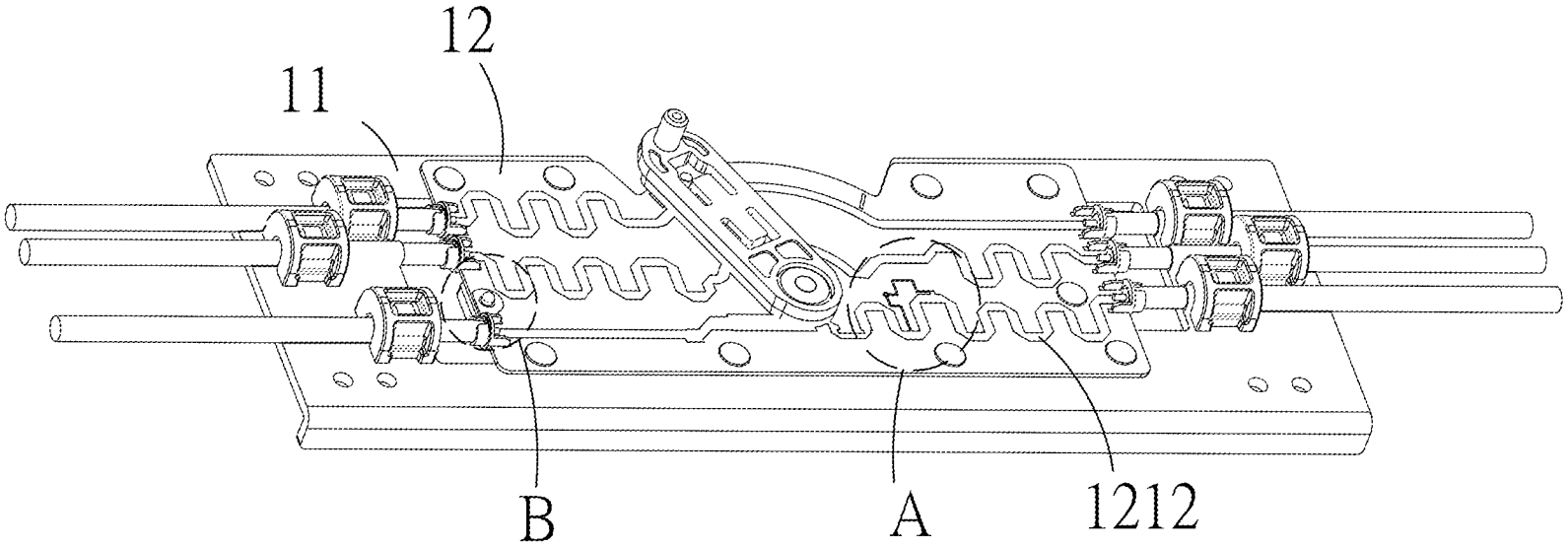
FIG. 6 is a schematic diagram of a phase shifter of an embodiment of the present disclosure.
Figure 7:
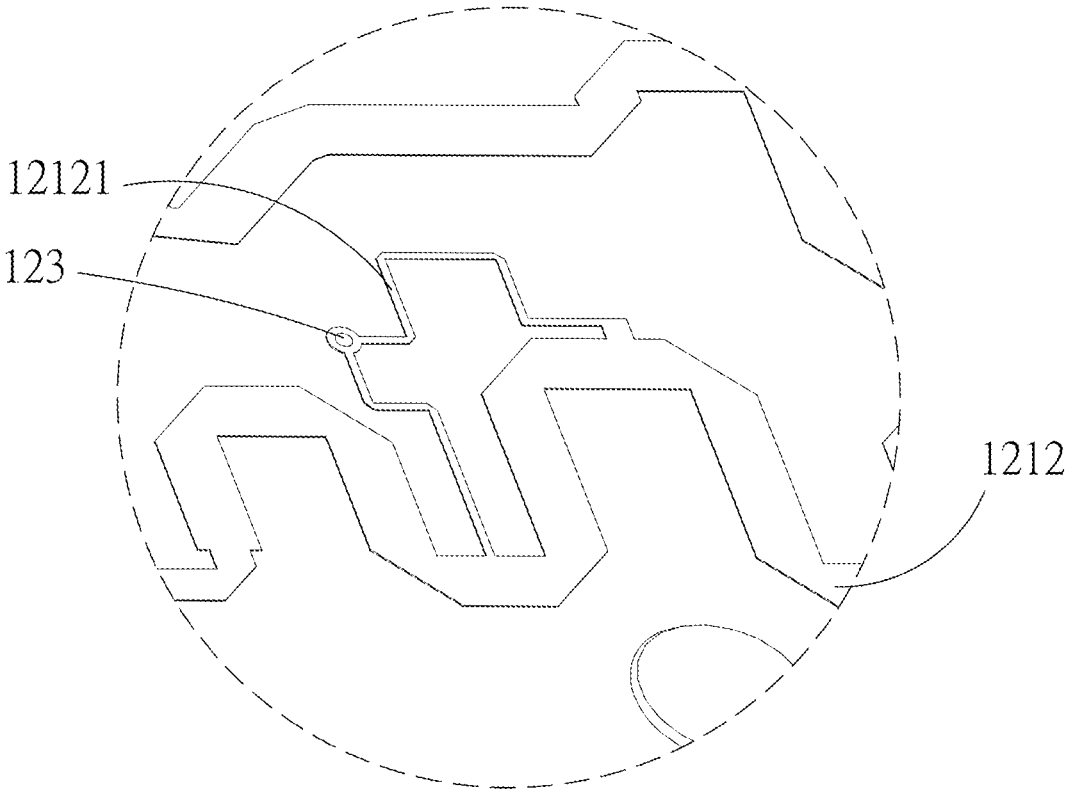
FIG. 7 is an enlarged view of area A of FIG. 6.

FIG. 5 and FIG. 6 are exploded view and schematic diagram of a phase shifter of an embodiment of the present disclosure. FIG. 7 is an enlarged view of area A of FIG. 6. As shown in the figures, the phase shifter 1 (FIG. 5) further comprises a ground layer 19 (FIG. 5) disposed on a surface of the circuit substrate 12 close to the base 11. The ground layer 19 can be made of conductive materials such as metal, conductive tape, etc. In this embodiment, the main output circuit section 1212 (FIGS. 6 and 7) of the main feeder circuit 121 (also referring to FIG. 2) further comprises a branch circuit section 12121 (FIG. 7). Two ends of the branch circuit section 12121 are connected with the main output circuit section 1212 (FIGS. 6 and 7). The circuit substrate 12 comprises a conductive through hole 123 (FIG. 7) penetrating the branch circuit section 12121. The branch circuit section 12121 is electrically connected to the ground layer 19 through the conductive through hole 123. The base 11 comprises a through hole corresponding to the conductive through hole 123. When a large amount of current passes through the circuit substrate 12, such as lightning strike, the branch circuit section 12121 could guide the excessive current to the ground layer 19 through the conductive through hole 123 to keep the phase shifter 1 from being damaged. The branch circuit section can also be provided on the output circuit section of the sub-feeder circuit 122, which would not be repeated herein.

Figure 8:
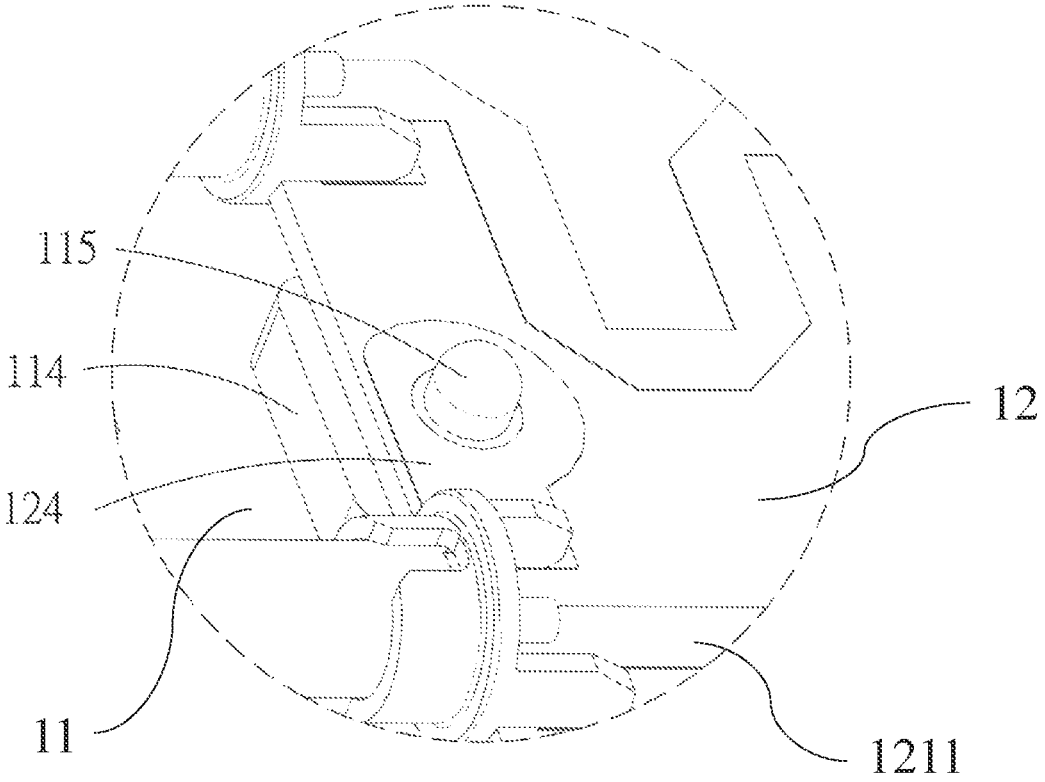
FIG. 8 is an enlarged view of area B of FIG. 6.

FIG. 8 is an enlarged view of area B of FIG. 6. As shown in the figure, the base 11 comprises a heat-conducting stage 114 and a heat-conducting column 115. The heat-conducting stage 114 and the heat-conducting column 115 are disposed adjacent to the main input circuit section 1211. The circuit substrate 12 comprises a tin plate 124. The heat-conducting column 115 passes through the circuit substrate 12. The heat-conducting stage 114 and the circuit substrate 12 are pressure-riveted and secured through the heat-conducting column 115. The heat-conducting column 115 is soldered to the tin plate 124. The heat-conducting stage 114 could be made of a metal having excellent heat conductivity, for example, silver, copper, gold, aluminum, tin, or any other suitable metal material, or an alloy comprising the above metal materials, but should not be limited thereto. Similarly, the heat-conducting column 115 could be made of a material that is the same or similar to the material of the heat-conducting stage 114. The circuit of the circuit substrate 12 generates heat during signal transmission, and the generated heat is positively correlated with the signal power. When the heat generated during the signal transmission process is excessive, the resistance of the circuit would be significantly increased, causing the circuit to melt and to be broken. In view of this problem, the tin plate 124 and the heat-conducting column 115 could guide the heat to the heat-conducting stage 114. The heat-conducting stage 114 dissipates the heat by heat radiation or heat convection to effectively avoid the circuit burning, indicating that the phase shifter 1 can carry a greater signal power. Besides, this embodiment can also be performed with the aforementioned ground layer 19, which is an excellent conductor for electricity and heat for further heat dissipating. Practically, with the above-mentioned heat-conducting elements, the phase shifter 1 could satisfy the power test of 250 W for 2 hours.

Figure 9:
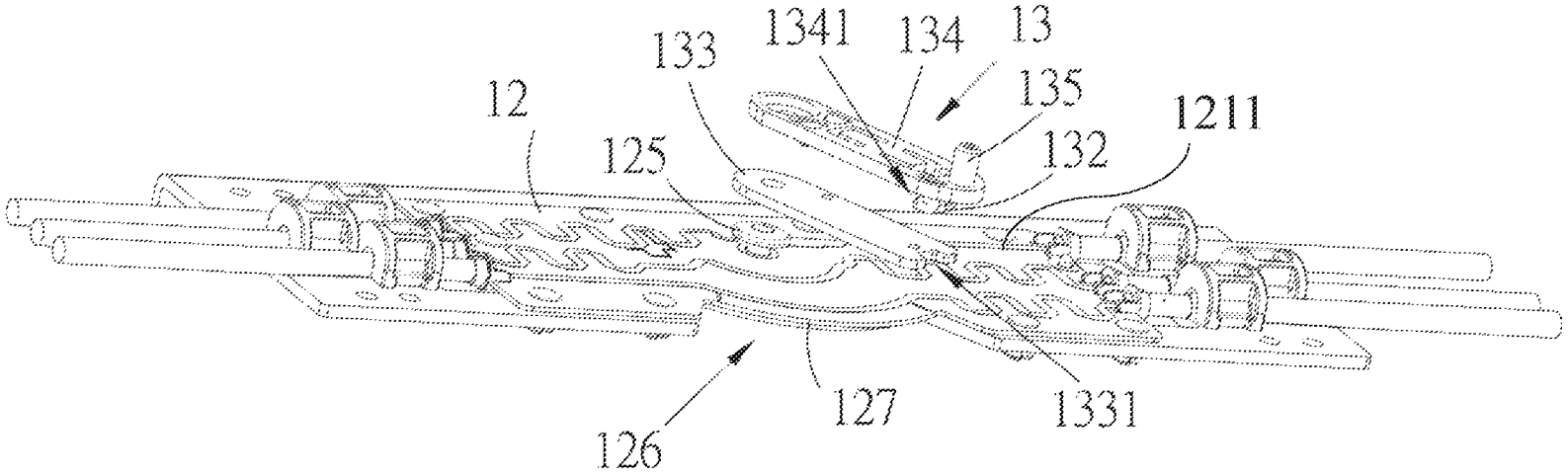
FIG. 9 is another exploded view of a phase shifter of an embodiment of the present disclosure.

FIG. 9 is another exploded view of a phase shifter of an embodiment of the present disclosure. Referring to FIG. 9 and FIG. 3, one end of the phase-shifting member 13 is rotatably connected to the circuit substrate 12 (FIG. 9) and is disposed at one end of the main input circuit section 1211. In one embodiment, the circuit substrate 12 comprises a positioning hinge 125 (FIG. 9), through which the phase-shifting member 13 is disposed on the circuit substrate 12. One end of the coupling band 131 (FIG. 3) is in contact with the main input circuit section 1211. An edge of the circuit substrate 12 comprises a notch 126 and an arc sidewall 127 disposed in the notch 126 as shown in FIG. 9. The other end of the phase-shifting member 13 is movably disposed on the arc sidewall 127 and is configured to move in the notch 126. In one embodiment, the other end of the phase-shifting member 13 comprises a hook 132 movably disposed on the arc sidewall 127.

Furthermore, the phase-shifting member 13 further comprises a coupling substrate 133 and a moving base 134. The coupling substrate 133 is disposed on the moving base 134. The coupling band 131 is disposed on a surface of the coupling substrate 133 attached to the circuit substrate 12. One end of the coupling substrate 133 in the notch 126 comprises a positioning notch 1331 as shown in FIG. 9. The hook 132 extends from the positioning notch 1331. The arc sidewall 127 is sandwiched between the hook 132 and the coupling substrate 133.

In this embodiment, the moving base 134 further comprises a retaining notch 1341 corresponding to the positioning notch 1331 as shown in FIG. 9. Specifically, the retaining notch 1341 is formed by the hook 132 extending toward the arc sidewall 127. That is, the phase-shifting member 13 allows the hook 132 to be connected with the arc sidewall 127 through the retaining notch 1341, and to move in the notch 126.

In this embodiment, a holding part 135 is further provided on a surface of the moving base 134 away from the circuit substrate 12. The coupling substrate 133 coupled to the holding part 135 is driven to move by rotating the holding part 135, so that the coupling band 131 on the coupling substrate 133 can be connected with different output circuit sections to output signals having different phase values.

In summary, embodiments of the present disclosure provide a phase shifter. Since the phase shifter uses coaxial lines in equal length, producing coaxial lines in the spec of only one length could improve the product yield in the case of mass production, which could further avoid the lack of accuracy due to tangent tolerances.

It is to be understood that the term "comprises", "comprising", or any other variants thereof, is intended to encompass a non-exclusive inclusion, such that a process, method, article, or device of a series of elements not only comprise those elements but further comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. A phase shifter, comprising:

a base;

a circuit substrate disposed on the base, comprising a main feeder circuit and at least one sub-feeder circuit, the main feeder circuit comprising a main input circuit section, the at least one sub-feeder circuit being disposed on one side of the main feeder circuit, the at least one sub-feeder circuit comprising two output circuit sections and an arc circuit section; the arc circuit section being disposed between the two output circuit sections;

a phase-shifting member rotatably connected with the circuit substrate, comprising a coupling band, one end of the coupling band corresponding to and being coupled to the main input circuit section while the other end of the coupling band corresponding to and being coupled to the arc circuit section;

a plurality of first output cables being respectively connected to one end of the corresponding one of the two output circuit sections away from the arc circuit section, each of the phase values output by a respective one of the plurality of first output cables is different from phase values output by other ones of the plurality of first output cables; and a plurality of cable securing members, wherein the plurality of the first output cables being respectively secured on the base through the corresponding cable securing members;

wherein the plurality of first output cables are of the same length; the length of one of the two output circuit sections is different from the length of other ones of the two output circuit sections; the respective length of each of the output circuit sections is determined by the phase value output by the corresponding first output cable connected with the corresponding output circuit section.

2. The phase shifter according to claim 1, wherein at least one of the two output circuit sections comprises a bent section.

3. The phase shifter according to claim 2, wherein each of the two output circuit sections comprises a bent section; each of the bent sections comprises at least one bent part; wherein the number of the bent parts of the bent section of one of the two output circuit sections is greater than the number of the bent parts of the bent section of another of the two output circuit sections.

4. The phase shifter according to claim 3 further comprising an input cable connected with one end of the main input circuit section away from the coupling band, the length of the input cable being identical to the length of at least one of the plurality of first output cables.

5. The phase shifter according to claim 4 further comprising an second output cable, the main feeder circuit further comprising a main output circuit section, one end of the main output circuit section being connected with the main input circuit section while the other end of the main output section being connected with the second output cable, the phase value output by the second output cable being different from the phase values output by the plurality of first output cables, the length of the second output cable being identical to the length of the first plurality of output cables, the length of the main output circuit section being determined by the phase value output by the second output cable.

6. The phase shifter according to claim 5, wherein the main output circuit section comprises a bent section comprising a plurality of bent parts; the number of the bent parts of the bent section of the main output circuit section is greater than the number of the bent parts of the bent section of the two output circuit sections.

7. The phase shifter according to claim 6, wherein the bent parts of each of the two output circuit sections and the plurality of bent parts of the main output circuit section are a plurality of U-shaped components arranged in series.

8. The phase shifter according to claim 5 further comprising a plurality of cable connectors, wherein the plurality of first output cables, the second output cable and the input cable being respectively secured on the circuit substrate through the corresponding cable connectors, the second output cable, and the input cable being respectively secured on the base through the corresponding cable securing members.

9. The phase shifter according to claim 8, wherein the base comprises a substrate securing part, an opening and a cable securing part; the opening penetrates the base and is disposed between the substrate securing part and the cable securing part; the circuit substrate is secured to the substrate securing part; an edge of the circuit substrate is overlapping with the opening; each of the cable connectors is disposed in the opening and is clamped on the edge of the circuit substrate; the cable securing member comprises a wire accommodating groove and an engaging member wherein; the engaging member is engaged with the cable securing part; the plurality of the first output cables, the second output cable, and the input cable are respectively accommodated in the corresponding wire accommodating grooves.

10. The phase shifter according to claim 1, wherein the main input circuit section comprises an input end part and a coupling end part; the coupling end part is correspondingly coupled to the coupling band; the input end part has a consistent width.

11. The phase shifter according to claim 1 further comprising a ground layer disposed on a surface of the circuit substrate closest to the base.

12. The phase shifter according to claim 1, wherein one end of the phase-shifting member is rotatably connected to the circuit substrate and is disposed at one end of the main input circuit section; one end of the coupling band is in contact with the main input circuit section; an edge of the circuit substrate comprises a notch and an arc sidewall that is disposed in the notch; the other end of the phase-shifting member is movably disposed on the arc sidewall and is configured to move in the notch.

13. The phase shifter according to claim 12, wherein the other end of the phase-shifting member comprises a hook movably disposed on the arc sidewall.

14. The phase shifter according to claim 13, wherein the phase-shifting member comprises a coupling substrate and a moving base; the coupling substrate is disposed on the moving base; the coupling band is disposed on a surface of the coupling substrate which is attached to the circuit substrate; one end of the coupling substrate that is positioned in the notch comprises a positioning notch; the hook extends from the positioning notch; the arc sidewall is sandwiched between the hook and the coupling substrate.

15. A phase shifter, comprising:

a base;

a circuit substrate disposed on the base, comprising a main feeder circuit and at least one sub-feeder circuit, the main feeder circuit comprising a main input circuit section, the at least one sub-feeder circuit being disposed on one side of the main feeder circuit, the at least one sub-feeder circuit comprising two output circuit sections and an arc circuit section; the arc circuit section being disposed between the two output circuit sections;

a phase-shifting member rotatably connected with the circuit substrate, comprising a coupling band, one end of the coupling band corresponding to and being coupled to the main input circuit section while the other end of the coupling band corresponding to and being coupled to the arc circuit section; and a plurality of first output cables being respectively connected to one end of the corresponding one of the two output circuit sections away from the arc circuit section, each of the phase values output by a respective one of the plurality of first output cables is different from phase values output by other ones of the plurality of first output cables;

wherein the plurality of first output cables are in the same length; the length of one of the two output circuit sections is different from the length of other ones of the two output circuit sections; the respective length of each of the output circuit sections is determined by the phase value output by the first output cable connected with the corresponding output circuit section;

wherein the base comprises a heat-conducting stage and a heat-conducting column; the circuit substrate comprises a tin plate; the heat-conducting column passes through the circuit substrate; the heat-conducting stage and the circuit substrate are pressure-riveted and secured through the heat-conducting column; the heat-conducting column is soldered to the tin plate.

16. The phase shifter according to claim 15, wherein each of the two output circuit sections comprises a bent section; each of the bent sections comprises at least one bent part; wherein the number of the bent parts of the bent section of one of the two output circuit sections is greater than the number of the bent parts of the bent section of another of the two output circuit sections.

17. A phase shifter, comprising:

a base;

a circuit substrate disposed on the base, comprising a main feeder circuit and sub-feeder circuits, the main feeder circuit comprising a main input circuit section, each of the sub-feeder circuits being disposed on one side of the main feeder circuit, each of the sub-feeder circuits comprising two output circuit sections and an arc circuit section; the arc circuit section being disposed between the two output circuit sections;

a phase-shifting member rotatably connected with the circuit substrate, comprising a coupling band, one end of the coupling band corresponding to and being coupled to the main input circuit section while the other end of the coupling band corresponding to and being coupled to the arc circuit section; and a plurality of first output cables being respectively connected to one end of the corresponding one of the two output circuit sections away from the arc circuit section, each of the phase values output by a respective one of the plurality of first output cables is different from phase values output by other ones of the plurality of first output cables;

wherein the plurality of first output cables are in the same length; the length of one of the two output circuit sections is different from the length of other ones of the two output circuit sections; the respective length of each of the output circuit sections is determined by the phase value output by the first output cable connected with the corresponding output circuit section;

wherein a gap exists between the two output circuit sections of each of the sub-feeder circuits and the two output circuit sections of the adjacent sub-feeder circuit; the gap is greater than or equal to 2.5 mm.

18. The phase shifter according to claim 17, wherein each of the two output circuit sections comprises a bent section; each of the bent sections comprises at least one bent part; wherein the number of the bent parts of the bent section of one of the two output circuit sections is greater than the number of the bent parts of the bent section of another of the two output circuit sections.

* * * * *